US005375911A

United States Patent [19]

Morrow

[11] Patent Number: 5,375,911

[45] Date of Patent: Dec. 27, 1994

[54] CHAIR TO FACILITATE SITTING AND STANDING

[76] Inventor: Kristen R. Morrow, 21 Birchbrook Dr., Valhalla, N.Y. 10595

[21] Appl. No.: 900,185

[22] Filed: Jun. 17, 1992

[51] Int. Cl.[5] ..... A47C 3/02

[52] U.S. Cl. ..... 297/258; 297/272; 297/DIG. 10

[58] Field of Search ..... 297/258, 272, DIG. 10, 297/419, 411.42

[56] References Cited

U.S. PATENT DOCUMENTS

| | | | |
|---|---|---|---|
| 1,297,718 | 3/1919 | Mueller | 297/258 |
| 1,497,426 | 6/1924 | Arnold | 297/258 X |
| 1,834,345 | 12/1931 | Nelson | 297/272 X |
| 3,099,477 | 7/1963 | O'Herron | 297/258 X |
| 3,526,429 | 9/1970 | Metzger | 297/258 |
| 4,109,960 | 8/1978 | Stinchfield | 297/258 |
| 4,159,146 | 6/1979 | Braconnier et al. | 297/258 |
| 4,555,139 | 11/1985 | Leib . | |
| 4,595,234 | 6/1986 | Kjersem . | |
| 4,786,105 | 11/1985 | Sheehan . | |
| 5,178,438 | 1/1993 | Beger | 297/258 |

FOREIGN PATENT DOCUMENTS

| | | | |
|---|---|---|---|
| 1026838 | 5/1953 | France | 297/258 |
| 2569965 | 3/1986 | France | 297/258 |

*Primary Examiner*—Peter M. Cuomo
*Assistant Examiner*—Jerry Redman
*Attorney, Agent, or Firm*—Brooks Haidt Haffner & Delahunty

[57] ABSTRACT

A chair is described which facilitates sitting and standing by the user, especially elderly or physically handicapped persons. The chair is of rigid construction having a two-plane rocker bottom providing a horizontal back plane on which the chair is disposed when the occupant is seated, and a front plane which is angled upwardly in the forward direction at an angle of from 10° to 20° from the rocker fulcrum point therebetween. Rear legs extend perpendicularly upward from the rearward ends of the back plane, and front legs extend substantially perpendicularly upward from the forward ends of the front plane. A seat which angles upwardly in the forward direction and a rearwardly angled backrest are attached between the front legs and rear legs, and counterweighting forward of the fulcrum balances and stabilizes the chair on either of its front or back rocker planes. Horizontal armrests extend forwardly to the front legs and above the forward end of the seat. Seat depth, seat height and the location of the rocker fulcrum are determined by, and preferably correspond to particular anthropometric dimensions of the intended user or users of the chair, as described.

15 Claims, 2 Drawing Sheets

CHAIR TO FACILITATE SITTING AND STANDING

FIELD OF THE INVENTION

This invention relates to chairs intended for use by physically handicapped or elderly persons. More particularly, it relates to chairs having features which assist the user in rising from, and in sitting down on the chair.

BACKGROUND OF THE INVENTION AND THE PRIOR ART

Persons having physical disabilities or infirmities which inhibit their mobility more often have difficulty in standing from a sitting position and in easing themselves into a chair when sitting. A characteristic of the common chair designed for persons without such handicaps is the positioning of the user's weight at back of the seat, thereby relieving the legs from body forces. The act of standing up requires transfer of the user's weight from the back of the chair to his or her legs, which places large stress primarily on the knees and arms as the weight shifts and the body is lifted from the chair. When sitting, the user must be prepared to suddenly shift his or her body weight outside of the normal balanced condition and towards the back of the chair.

Previous attempts to design chairs to assist the seated user in lifting his or her body from the chair when rising to a standing position or in easing the user into a seated position more often have included mechanically or hydraulically, or even electrically tiltable seat portions which are not user-friendly and are often intimidating. Examples of such prior art devices are shown in U.S. Pat. Nos. 3,039,818 (Frank); 3,259,427 (Wiest); 3,679,260 (Morse-Brown); 3,851,917 (Horstmann et al); 4,059,305 (Ammirata); and 4,778,217 (Lane). All are comparatively complicated, expensive, and unattractive, and their specialized features for the purpose constantly remind the user of his or her infirmity.

Other chairs without such operable features are known for assisting a patient to rise from the chair, such as the resilient chairs described in U.S. Pat. Nos. 4,555,139 (Leib) and 4,595,235 (Leib), or for assisting a person who is already sitting in the chair to position the chair forwardly or backwardly as is most comfortable when performing a specific task or resting. See, for example, U.S. Pat. Nos. 4,595,234 (Kjersian) and 4,796,105 (Sheehan et al).

By contrast, it is intended by the present invention to provide a chair which does not have any such mechanically, hydraulically, or electrically movable parts but, rather, utilizes the user's normal movements and shifts in body weight to facilitate his or her sitting down in, and rising from the chair. Thus, no power source will be required, and the assistance to the user will be inherent from the design features of the chair itself. The user will sit or stand using slow, even movements, as is most comfortable for the elderly and the handicapped.

The chair must be relatively stable, comfortable and should comply with the appropriate anthropometric and ergonomic data of the intended user. Further, the chair should be of normal size (i.e., within the confines of a four-foot cube), and its appearance should be simplistic and aesthetically pleasing.

BRIEF DESCRIPTION OF THE INVENTION

Briefly and generally describing a chair in accordance with the invention, it has what may be referred to as a two-plane rocker bottom whose rocking point or fulcrum is at a particular location with reference to the anticipated height, weight, and the centers of gravity of pertinent body parts of the seated user. The rocker utilizes the redistribution of body weight to the occupant's advantage. That is, by shifting one's center of gravity beyond the pivot point, pivoting occurs and the chair rocks from the rearward to the forward of the two planes, the latter being the chair position which facilitates rising out of the chair to a standing position.

The two-plane rocker with a properly positioned and narrowly curved fulcrum ensures chair stability yet an inherent feeling of control for the user. When a person is seated, the chair is comfortably reclined at a slight rearward angle and does not easily rock.

The location and curvature of the fulcrum are such that the chair remains stable on its back plane when one seated in it incidentally leans slightly forward or reaches forwardly with the arms as, for example, when being handed something.

When the seated person wishes to stand, pivoting the chair to its forward, downwardly inclined position which facilitates standing, occurs only as the user consciously shifts his or her center of gravity forwardly of the pivot location. The chair then rotates from its rearward stable plane on to its forward, second stable plane in which the user realizes a better chair angle from which to rise. The tilt angle of the rocker is small and the rocker fulcrum has a relatively small radius curvature, so that the chair does not impart a sense of instability or momentary loss of control as it pivots forwardly. In this forwardly tilted position the rigid nature and forward location of the armrests of the chair provide a stable platform on which arm pressure may be most conveniently applied as the user rises from the chair. In its forward, downwardly inclined position the chair is stable, and remains poised to facilitate reseating of the user at a later time. Either by comparatively heavy cross supports or by special counterweighting, the chair is counterweighted at particular locations to assure that it remains stable in both its forwardly tilted and horizontal positions.

When reseating, the user with his or her back to the chair places the heels of the hands on the now forwardly positioned rigid armrests to support the body weight as it assumes the seating position. Early engagement of the undersides of the thighs with the forwardly tilted seat of the chair occurs while the chair is in its stable, forward position. Thus, the chair does not tend to slide or tilt rearwardly, and the user experiences a sense of stability and control as he or she sits down. As the user's weight shifts rearwardly, the chair tilts backwardly in an easy, controllable fashion over a small angle to a very stable position on its rearward, horizontal plane.

The contours of the back and seat of the chair are such as to provide a slight angular rise of the seat towards the front to support the undersides of the knees, as will be seen. A large radius curvature fairs the seat bottom into the back of the chair, to provide maximum comfort. The orientation of the seat relative to the rocker plane therebelow provides comfortable, relaxed usage of the chair, yet the seat provides support for the legs as the occupant stands. In the sitting position the front of the seat is above the horizontal with respect to the angular plane of the seat for knee support, whereas it is below the horizontal when the chair is tilted forwardly so that the thigh is higher than the knee to facilitate rising.

Although any given chair in accordance with the invention may benefit several different users whose sizes are similar, for maximum benefits the height of the chair seat should be altered in accordance with the height of the user. More specifically, the seat height of the chair should be varied with relation to the length of the lower leg, or calf height of the person for whom the chair is designed to be used. If the chairs are to be mass produced, it is believed that three standard chair sizes will serve the range of heights of potential users.

These and other objects, features and advantages of the invention will become more readily apparent from the following detailed description of preferred embodiments thereof, when taken with reference to the accompanying drawings, in which.

Figure 1:
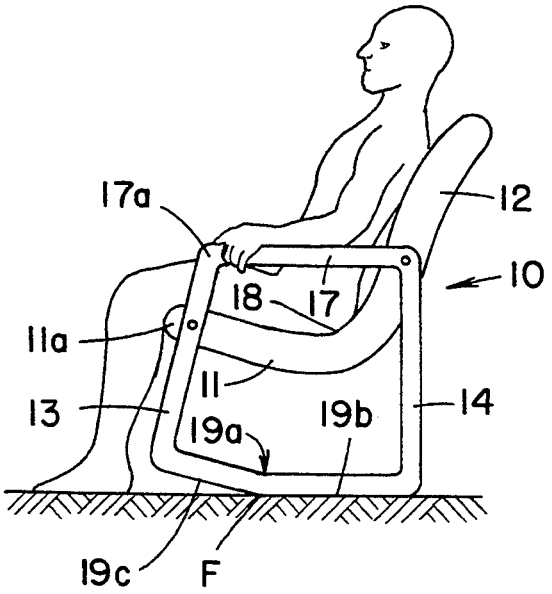
FIG. 1 is a somewhat diagrammatic showing of a chair in accordance with the invention in the seated position of the user.

Referring to the drawings, a chair 10 in accordance with the invention has a seat 11 and backrest 12 which are supported vertically by respective pairs of upright rigid front legs 13 rigid rear legs 14 between which the seat 11 is attached, as by bolts 15 through each front leg 13. The backrest 12 may attached between the rear legs 14 in similar manner but, in the preferred embodiment, it is attached, as by bolts 16, between the pair of horizontal and rigid armrests 17 which extend between are attached at their opposite ends 17*a* and 17*b* respectively to the upper ends 13*a* of the front legs 13 and the upper ends 14*a* of the rear legs 14, as shown.

The seat 11 and backrest 12 may be of wooden frame or any other substantially rigid conventional construction (not shown) and are preferably upholstered in conventional manner. For comfort, the seat and backrest have smoothly curved connection to each other, as at 18, to support the buttocks and lumbar region of the back. When the user is seated normally in the chair, the seat 11 is inclined upwardly from the curved connection 18 towards its front end 11*a* at an angle of approximately fifteen degrees (15°) to the horizontal. The backrest 12 is inclined rearwardly with respect to the vertical at any conventional angle, e.g., about fifteen degrees (15). The junction between these planes defines the rearward end 11*b* of the seat 11, as seen in FIG. 4, the depth of the seat being measured between the seat ends 11*a*, 11*b*.

The chair 10 further has a rigid two-plane rocker bottom 19 which is defined in the preferred embodiment by the pair of forwardly and rearwardly extending rigid two-plane bottom rails 19*a*. Each bottom rail 19*a* has a horizontal rear section or back plane 19*b*, and an inclined forward section or front plane 19*c* whose incline is in the forward direction of the chair from the pivot or fulcrum point F which is the location of conjunction between the planes 19*b* and 19*c*.

The location of the fulcrum point F is below the location of the center of gravity of the thigh, indicated by reference letters CGT in FIG. 4, of a seated user of the chair. Its precise location is dictated by the anthropometric dimensions of the thigh and the center of gravity of the intended user, such that a conscious shift of body weight will be required to cause pivoting or rotation of the chair about the fulcrum point F from the back plane 19*b* on to the front plane 19*c*, or from the front plane 19*c* on to the back plane 19*b*. According to anthropometric charts, the center of gravity of the thigh CGT (FIG. 4) in average male or female humans lies at a point which is 43.3% of the thigh length from the buttocks and 56.7% of the thigh length from the knee. Total thigh length is measured between the buttocks and the knee, and in male humans averages from 21.8 to 25.7 inches, and in females from 20.2 to 24.4 inches. Accordingly, the location of the center of gravity of the thigh CGT will vary from about 8.75 inches to about 11.1 inches forward of the rearward end 11*b* of the seat 11, depending upon the size and sex of the intended user of the chair 10. Moreover, the range of lengths of the undersides of the thigh from the back of the knee to the buttocks, which determines the seating area of the body and thus, the seat depth d (Fig.4) in chairs, is from 15.8 inches for a small female to 20.1 inches for a large male, according to anthropometric charts, The seat height h is determined by extrapolation from the dimension of the lower leg from the back of the knees to the heel, which ranges from 14.3 inches for a small female to 18.5 inches for a large male.

Figure 3:
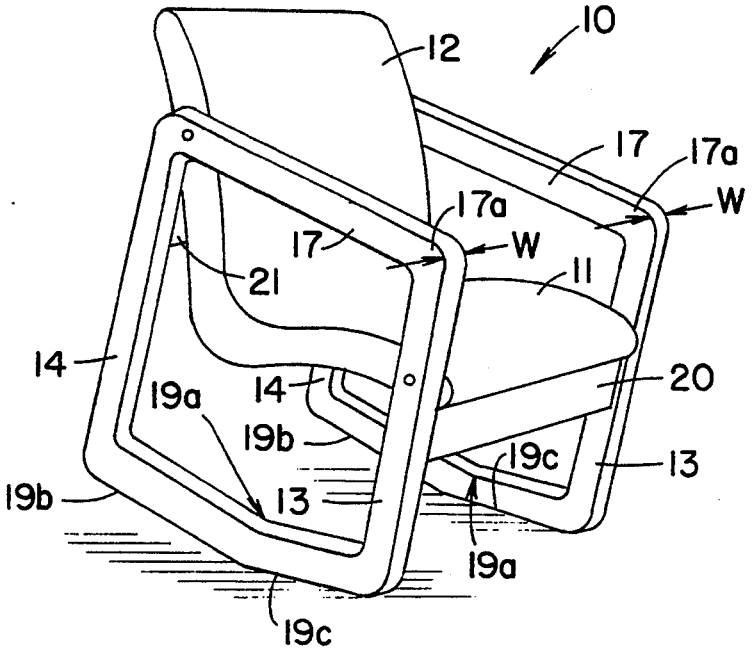
FIG. 3 is a perspective view of a preferred embodiment of the chair, as seen in its forward, inclined position.
Figure 4:
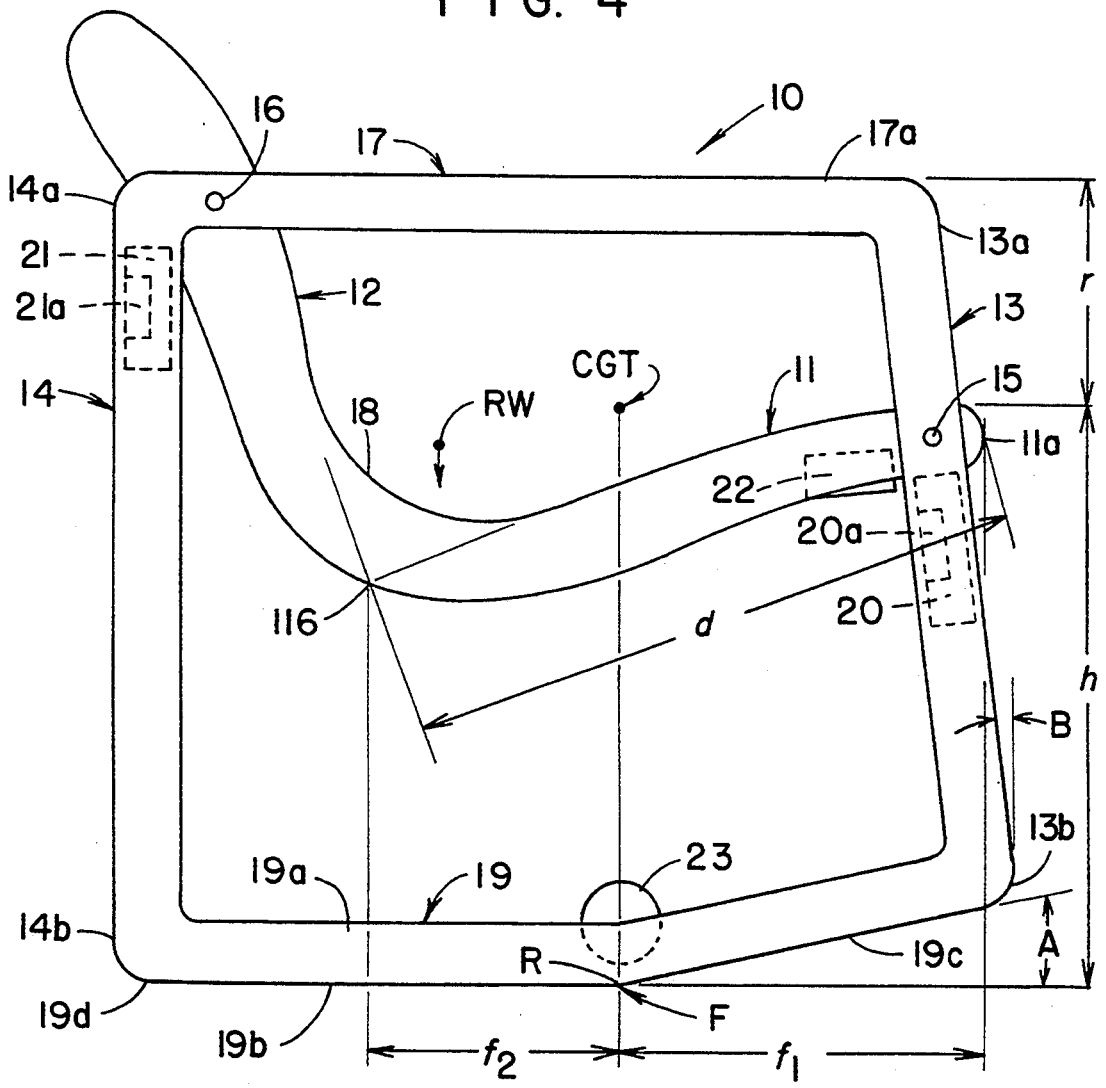
FIG. 4 is a diagrammatic side view, to an enlarged scale, illustrating features of both the preferred and an alternative embodiment of the invention.

Using these criteria, and as illustrated in FIG. 4, a chair 10 of the invention designed for use by a female user who is 5'5" tall is provided with a seat 11 whose seat depth d is 17 inches between its front end 11*a* and its rearward end 11*b*, and whose seat height h at its forward end 11*a* is 17 inches above floor level when the seat is resting on its back plane 19*b* as seen in FIG. 4, and so that the seat height h will be approximately the aforementioned 14.3 inches from the floor when the chair 10 is pivoted to its forward position resting on its front plane 19*c*. For such a person, the dimension $f_1$ of the fulcrum point F rearward of the seat front end 11*a* is 10 inches, such that the dimension $f_2$ forward from the location of the seat rearward end 11*b* is 7 inches, both dimensions being measured on the horizontal. The top of the armrest 17 at its forward end 17*a*, where it will be grasped by the user when rising or sitting, is a distance r above the seat front end 11*a*, which in the preferred embodiment is substantially 8 inches, thus locating the armrest front end 25 inches above ground level. As illustrated in FIG. 3, the width w of each armrest 17, at least at its forward end 17*a*, is at least 1½ or 2 inches, as will receive the user's hands comfortably.

Of course, the foregoing are probably the smallest dimensions for an average user. Although, ideally, the chair 10 should be sized as described for each particular user, it is believed that the chair 10 can be made in only three standard sizes to accommodate users of virtually all sizes. The smallest would be that described, whose armrest is 25 inches above floor level; an intermediate size would be one whose armrest would be 27 inches above floor level; and a large size would be one whose armrest would be 29 inches high. The other chair dimensions would be correspondingly different, reference being had to averages contained in anthropometric charts as previously described.

The plane angle A (FIG. 4) which is the angle of rise of the front plane 19c relative to the horizontal back plane 19b of the two-plane rocker bottom 19, is comparatively small, being only fifteen degrees (15°) in the preferred embodiment. The plane angle A may be made slightly larger or smaller, within a range of from about ten degrees (10°) to about twenty degrees (20°), as the chair size is increased, depending upon the angle of inclination of the seat 11 between its rearward and forward ends 11b, 11a. For shallower seat angles, e.g. ten degrees (10°) the angle A may be made smaller, i.e. to ten degrees (10°). For more inclined seat angles the angle A can be larger, e.g., up to twenty degrees (20°). However, the preferred angle of fifteen degrees (15°) is believed appropriate for all chair sizes. The criteria used is the comfort and ease of sitting and standing of the user.

The fulcrum point F, which is at the conjunction between the back plane 19b and front plane 19c, is given a small radius of curvature R, approaching virtual single point contact, to facilitate pivoting of the chair between its two planes 19b, 19c, yet to maintain a feeling of chair stability when resting on either of those planes.

Figure 2:
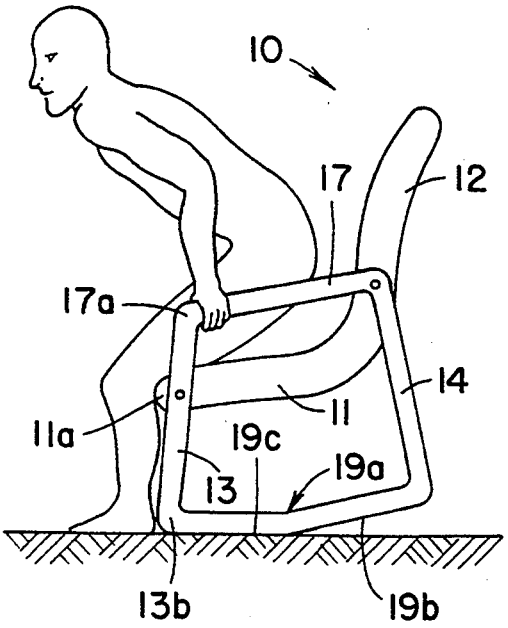
FIG. 2 is a similar showing of the chair in its forward, inclined position in which it facilitates either the rising of the user out of the chair, or the initial stage of the act of seating oneself into the chair.

The front legs 13 are disposed perpendicular to the back plane 19b, (i.e., perpendicular to the floor) in the smaller size chair, substantially as indicated in FIG. 3. However, in the larger sizes the legs 13 are preferably disposed either perpendicular to the front plane 19c, or at an angle B rearwardly of an imaginary plane erected perpendicular to the front plane 19c as illustrated in FIG. 4, the preferred angle B being equal to one-half the plane angle A. Thus, since A is preferably 15°, the angle B is preferably seven and one-half degrees (7½°). It will be appreciated that such slight rearward angular disposition of the front legs 13 will impart a feeling of stability to a taller user when initially seating himself or herself with the chair 10 resting on its front plane 19c, as illustrated in FIG. 2. That is, the vertically downward pressure exerted by the heels of the hands on the armrest forward ends 17a, which extend forwardly to above the seat forward end 11a as shown, is applied only slightly rearward of the front leg bottom ends 13b as the user seats himself or herself. The same is true as the user raises himself or herself off the chair when rising from the seated position.

In the preferred embodiment the rear legs 14 are disposed perpendicular to the back plane 19b as illustrated in FIG. 4. However, they may be angled forwardly at their upper ends as desired, for appearance or other reasons. In this regard it should be noted that the back plane 19b must have sufficient length (or, more properly, depth) rearward of the fulcrum F to extend to a location at its rearward end 19d which will be at least beneath the user's shoulders, for stability in the seated position. Thus, the rear legs 14 should not be angled rearwardly if such would dispose the user's shoulders rearward of the rearward end 19d of the back plane 19b. The height of the backrest 12 may be that which most appropriately suits the style of the chair, or the comfort of the user.

The respective pairs of front legs 13 and rear legs 14 are spaced laterally apart by respective transversely extending rigid chair rails 20 and 21. The chair rail 20 at the front of the chair, which rigidly braces the front legs 13 with respect to each other, is disposed immediately beneath the chair seat 11, so that it may additionally support the seat at its front end 11a, as seen especially in FIG. 4. The rear chair rail 21 rigidly braces the rear legs 14 apart, and is preferably disposed at an elevation immediately below, and so as to support the backrest 12, as illustrated in FIG. 4.

It is believed that the respective weights of these relatively massive chair rails 20 and 21 and their respective distances from the fulcrum F will provide adequate counterweighting to balance the chair 10 such that it remains stable on either one or the other of its positional planes 19b, 19c. Such counterweighting assists the user when consciously pivoting the chair between the two planes, and additionally lends stability to the chair 10 in either position. Of course, depending upon chair design, additional weight in the form of a lead or other metal bar 20a or 21a may be fastened, preferably by insetting as shown, to one or both rails 20 and 21.

Additionally or alternatively to the weight of the front cross rail 20, a balancing counterweight 22 may be attached beneath the chair seat 11 at a location forward of the fulcrum F, as shown in FIG. 4. The counterweight 22 will be found most useful when the chair design calls for a single lower cross rail 23 extending between and rigidly bracing apart the two-plane bottom rails 19a at the location of the fulcrum F, as seen in FIG. 4. In such modified form of the invention, the front cross rail 20 and the rear cross rail 21 may be omitted, and a four pound (4 lb.) counterweight 22 is attached beneath the seat 11 at a position which is immediately behind the forward end 11a of the seat, as shown. This counterweight 22 together with the weight of the chair 10 forward of the fulcrum F counterbalances the weight of the chair behind the fulcrum F, so that the chair is stable when positioned in either of its two positions, i.e., on its front plane 19C or on its back plane 19b. The amount of the weight 22 and its precise location forward of fulcrum F are determined so as to balance the otherwise resolved weight RW (FIG. 4) of the chair at the location of its center of gravity, which will be rearward of fulcrum F.

Thus, when the unoccupied chair 10 is tipped on to its front plane 19c as illustrated in FIG. 3 it is quite stable, and remains in that position ready to ease the user into seated position thereon. If the unoccupied chair 10 is tipped on to its back plane 19b as illustrated in FIG. 4 it is also stable, and must be manually tipped to its front plane position with deliberateness, when such is desired.

Describing the manner in which the chair is used, the user places the unoccupied chair 10 in its forwardly tilted position, as seen in FIG. 3, to facilitate sitting. The user turns his or her back to the chair 10 and places the heels of the hands on the respective forward ends 17a of the armrests 17, as illustrated in FIG. 2. It will be noted that the perpendicular disposition of the legs 13 with respect to the front plane 19c, or the rearward angle B of the front legs 13 ensure that weight applied to the armrest ends 17a will be applied vertically downward through the front legs 13 to their lower ends 13b, so as to impart a greater sense of stability, yet the positions of the armrest ends 17a at the front of the chair 10 facilitates grasping of them by the hands. It will also be noted that the seat 11 is then disposed such that its top surface is substantially horizontal in the rearward direction of the chair 10, as best seen in FIG. 2. Because of its height h as determined anthropometrically as previously described, its front end 11a therefore receives the undersides of the thighs, directly behind the knees of the user, as soon as the user flexes his or her knees in the initial act of sitting down, as also seen in FIG. 2.

The user seats himself or herself in the chair 10 in a normal manner whereupon it will be realized that the chair tilts backwardly on to its back plane 19*b* in an easy and gentle manner, as illustrated in FIG. 1, as the user consciously shifts his or her now supported weight and center of gravity rearward of the fulcrum point F. The chair 10 remains stable while the user is in the seated position, even while the user reaches forward in a normal manner to shake hands, receive food, etc.

When the user wishes to rise from the chair 10 to stand up, he or she deliberately leans forward to shift the center of gravity of the body to a location forwardly of the fulcrum F while placing both hands on the respective forward ends 17*a* of the armrests 17. Such conscious action causes the chair 10 to pivot about the fulcrum F from its back plane 19*b* on to its front plane 19*c*, whereupon the occupant lifts himself or herself out of the chair to a standing position by exerting pressure on the heels of the hands in the usual manner. It will be found that considerably less effort is required, and considerably less leg exertion is experienced by the user when rising from the chair 10 because of the forwardly angled position of the chair seat 11 and the anthropometrically related dimensions and features of the chair, as previously described.

Proper locating of the fulcrum F, proper height, seat depth and disposition of the rigid chair seat 11, the rigid nature of the front and rear chair legs 13 and 14, and the proper forward extension and height of the forward ends 17*a* of the rigid armrests 17, as well as proper counterweighting of the chair when necessary, all contribute to the ease with which the chair 10 facilitates sitting and standing.

Thus has been described a chair in several embodiments for facilitating sitting and standing by the user, and which achieves all of the objects of the invention.

What is claimed is:

1. A chair for facilitating sitting and standing by a user, said user having knees with undersides, buttocks, and thighs having length extending between said undersides of said knees and said buttocks, said chair comprising a seat having a forward end and a rearward end and a depth extending between said forward end and said rearward end of said seat, rigid and substantially vertical front legs and rigid rear legs, said front legs and said rear legs substantially supporting said seat, a backrest extending upwardly from said rearward end of said seat, rigid and substantially horizontal armrests having respective rearward ends adjacent to said backrest and respective forward ends extending to respective locations substantially vertically above said forward end of said seat, and a rigid, two-plane rocker bottom comprising a back plane having a rearward end disposed rearwardly of said rearward end of said seat and extending forwardly from said rearward end of said back plane to a fulcrum of said rocker bottom and a front plane extending forwardly and at an upward angle from said fulcrum and having a forward end disposed vertically below said forward ends of said armrests, said fulcrum being located substantially beneath the center of gravity of said thighs of said user when seated in said chair, said center of gravity of said thighs being as determined with respect to said user from an anthropometric chart, and said depth of said seat being substantially equal to said length of said thighs, said chair further having means providing a counterweight whereby said chair is substantially stable when positioned on either of said front plane and said back plane of said rocker bottom.

2. A chair according to claims 1 wherein said user further has foot heels and leg calves having lengths extending between said foot heels and said undersides of said knees, and said forward end of said seat is disposed at a height above said forward end of said front plane which is substantially equal to said lengths of said calves of said user.

3. A chair according to claim 2, wherein said upward angle of said rocker bottom front plane is within the range of from about ten degrees (10°) to about twenty degrees (20°).

4. A chair according to claim 3, wherein said upward angle is substantially fifteen degrees (15°).

5. A chair according to claim 2, wherein said chair has a resolved weight and a center of gravity located in direction towards said backrest of said chair from a vertical plane through said fulcrum, and said chair further comprise a counterweight attached below said seat and located towards said forward end of said seat and at a distance from said vertical plane whereby said chair is substantially balanced when positioned on either of said front plane and said back plane of said rocker bottom.

6. A chair according to claim 5, wherein said chair has a rear crossrail extending between said rear legs at an elevation which is above said seat, and said counterweight comprises a front crossrail of said chair extending between said front legs.

7. A chair according to claim 1, wherein said two-plane rocker bottom has a small radius curvature between said front and back planes thereof.

8. A chair according to claim 1, wherein said front legs respectively extend perpendicularly upward from and with respect to said forward end of said front plane of said rocker bottom to the respective of said forward ends of said armrests.

9. A chair according to claim 1, wherein said front legs respectively extend upwardly from said said forward end of said front plane of said rocker bottom to the respective of said forward ends of said armrests, said front legs being disposed at a vertical angle towards said backrest of said chair with respect to a plane perpendicular to said front plane of said rocker bottom.

10. A chair according to claim 7, wherein said front legs are disposed at a vertical angle towards said backrest of said chair which is substantially equal to one-half said upward angle of said front plane of said rocker bottom.

11. A chair according to claim 1, wherein said front legs extend perpendicularly upward with respect to said back plane of said rocker bottom.

12. A chair according to claim 1, wherein said two-plane rocker bottom comprises a pair of two-plane bottom rails in laterally spaced apart relation to each other, and a bottom crossrail extending laterally between said two-plane bottom rails and located substantially adjacent to said fulcrum.

13. A chair according to claim 12, which further comprises a counterweight attached below said seat and located towards said forward end of said seat and at a distance from a vertical plane through said fulcrum, whereby said chair is substantially balanced when positioned on either of said front plane and said back plane of said rocker bottom.

14. A chair for facilitating sitting aid standing by a user, comprising a seat having a forward end and a rearward end and a depth extending between said forward end and said rearward end of said seat, rigid and substantially vertical front legs and rigid rear legs, said front legs and said rear legs substantially supporting said seat, a backrest extending upwardly from said rearward end of said seat, rigid and substantially horizontal armrests having respective rearward ends adjacent to said backrest and respective forward ends, said armrests at their said forward ends extending to respective locations substantially 8.0 inches above said forward end of said seat, and a rigid, two-plane rocker bottom comprising a back plane extending forwardly from said rear legs to a fulcrum and a front plane extending forwardly and at an upward angle of from about 15° to about 20° from said fulcrum to said front legs, said front legs extending substantially perpendicularly upward from and with respect to said front plane of said rocker bottom to the respective of said forward ends of said armrests, said fulcrum being located from about 8.75 inches to about 11.1 inches forward of a vertical plane through said rearward end of said seat, said depth of said seat being from about 15.8 inches to about 20.1 inches, and said forward end of said seat being disposed at a height above said forward end of said front plane which is from about 14.3 inches to about 18.5 inches, said height of said forward end of said seat and said depth of said seat and said location of said fulcrum being substantially directly proportional to each other within said dimensional ranges thereof, said chair further having means providing a counterweight whereby said chair is substantially stable when positioned on either of said front plane and back plane of said rocker bottom.

15. A chair according to claim 14, wherein said two-plane rocker bottom comprises a pair of two-plane bottom rails in laterally spaced apart relation to each other, and said chair further comprises a bottom crossrail extending laterally between said two-plane bottom rails and located substantially adjacent to said fulcrum, and a counterweight attached below said seat and located a distance towards said forward end of said seat from a vertical plane through said fulcrum.

* * * * *